US007856846B2

(12) United States Patent
Ho

(10) Patent No.: US 7,856,846 B2
(45) Date of Patent: Dec. 28, 2010

(54) MULTI-FUNCTIONAL AIR CONDITIONER

(76) Inventor: Ming-Tse Ho, 8F, No. 4, Lane 52, Sec. 4, Nanjing E. Road, Songshan Dist., Taipei (TW)

( * ) Notice: Subject to any disclaimer, the term of this patent is extended or adjusted under 35 U.S.C. 154(b) by 432 days.

(21) Appl. No.: 12/032,933

(22) Filed: Feb. 18, 2008

(65) Prior Publication Data

US 2008/0229779 A1 Sep. 25, 2008

(30) Foreign Application Priority Data

Mar. 23, 2007 (TW) ..... 96110088 A

(51) Int. Cl.
*F25B 1/00* (2006.01)

(52) U.S. Cl. ..... 62/498; 62/189; 62/518

(58) Field of Classification Search ..... 62/498, 62/457.9, 508, 518, 520, 189

See application file for complete search history.

(56) References Cited

U.S. PATENT DOCUMENTS

2005/0011210 A1* 1/2005 Wu ..... 62/238.6

* cited by examiner

*Primary Examiner*—Melvin Jones
(74) *Attorney, Agent, or Firm*—Fitch, Even, Tabin & Flannery

(57) ABSTRACT

A multi-functional air conditioner has a casing, a compressor, a cooler, an evaporator, at least two fans and at least one gate controller. The casing is stored with the compressor, the cooler and the evaporator that connected by multiple pipes, has two inlets, an outlet, a first gate, a second gate, a third gate and a fourth gate. The third and fourth gates are corresponding to the cooler. The first and second gates are corresponding to the evaporator. The fans are mounted respectively on the cooler and the evaporator to generate air flow. The gate controller selectively close the first gate, the second gate, the third gate and the fourth gate to change the route of the air flow according to the function that the multi-function air conditioner intends to provide. With such an air flow route change, air flow with different condition is discharged from the casing to provide air cooling, air warming, air exhausting, air recycling and air exsiccating function.

5 Claims, 4 Drawing Sheets

MULTI-FUNCTIONAL AIR CONDITIONER

BACKGROUND

1. Field of the Invention

The present invention relates to an air conditioner, and more particularly to a multi-functional air conditioner that is capable of providing air cooling, warming, exhausting, recycling and exsiccating functions.

2. Description of Related Art

Air conditioners are installed indoors and each has a casing and a compressor, a cooler and an evaporator mounted in the casing. Moreover, multiple pipes are mounted between the compressor, the cooler and the evaporator, and at least two fans mounted respectively on the cooler and the evaporator.

Generally, the conventional air conditioner aforementioned is implemented to reduce the temperature of the outer circumstance via coolant flow along the pipes to transmit heat and operation of the compressor, cooler and evaporator to discharge heat. Furthermore, the air conditioner is implemented to increase the temperature of the outer circumstance as well.

However, the conventional air conditioner is inadequate to have an air recycling function or an exhausting function at one time.

To overcome the shortcomings, the present invention provides a multi-functional air conditioner to obviate or mitigate the aforementioned problems.

SUMMARY OF THE INVENTION

The main objective of the present invention is to provide a multi-function air conditioner that is capable of providing air cooling, warming, recycling, exhausting and exsiccating functions in one settlement.

To achieve the objective, the multi-functional air conditioner in accordance with present invention comprises a casing, a compressor, a cooler, an evaporator, multiple pipes, at least two fans and at least one gate controller.

The casing holds the compressor, the cooler and the evaporator inside and is defined with two inlets, an outlet, a first gate, a second gate, a third gate and a fourth gate. The third and fourth gates are adjacent to the cooler. The first and second gates are adjacent to the evaporator.

The pipes are mounted between the compressor, the cooler and the evaporator and may have an expansion valve mounted thereon.

The fans are mounted respectively on the cooler and the evaporator to generate air flow.

The gate controller selectively close the first gate, the second gate, the third gate and the fourth gate to change the route of the air flow according to the function that the multi-functional air conditioner intends to provide. With change of the air flow, air flow with different conditions is discharged from the casing to provide air cooling, warming, recycling, exhausting or exsiccating functions.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
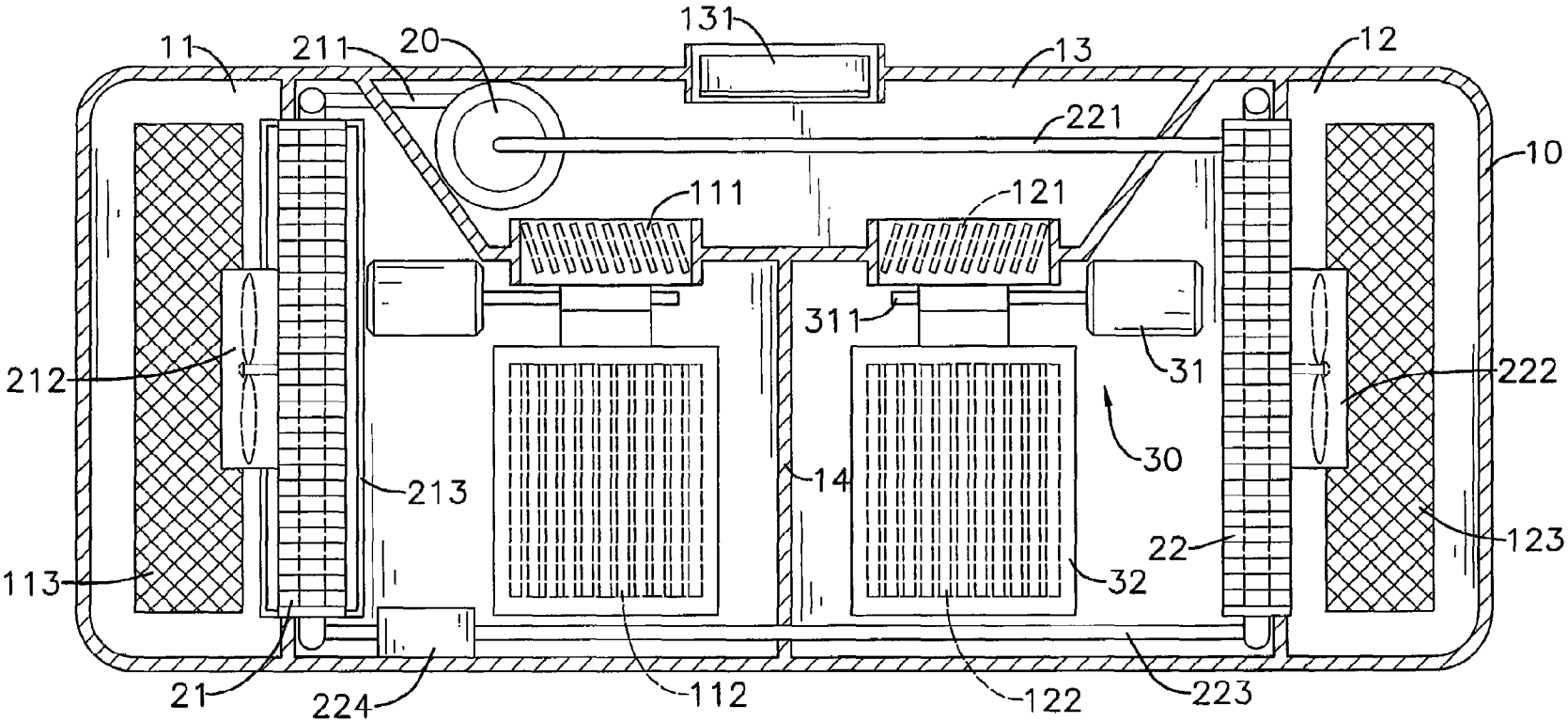
FIG. 1 is a top view in partial section of a multi-functional air conditioner in accordance with the present invention.
Figure 2:
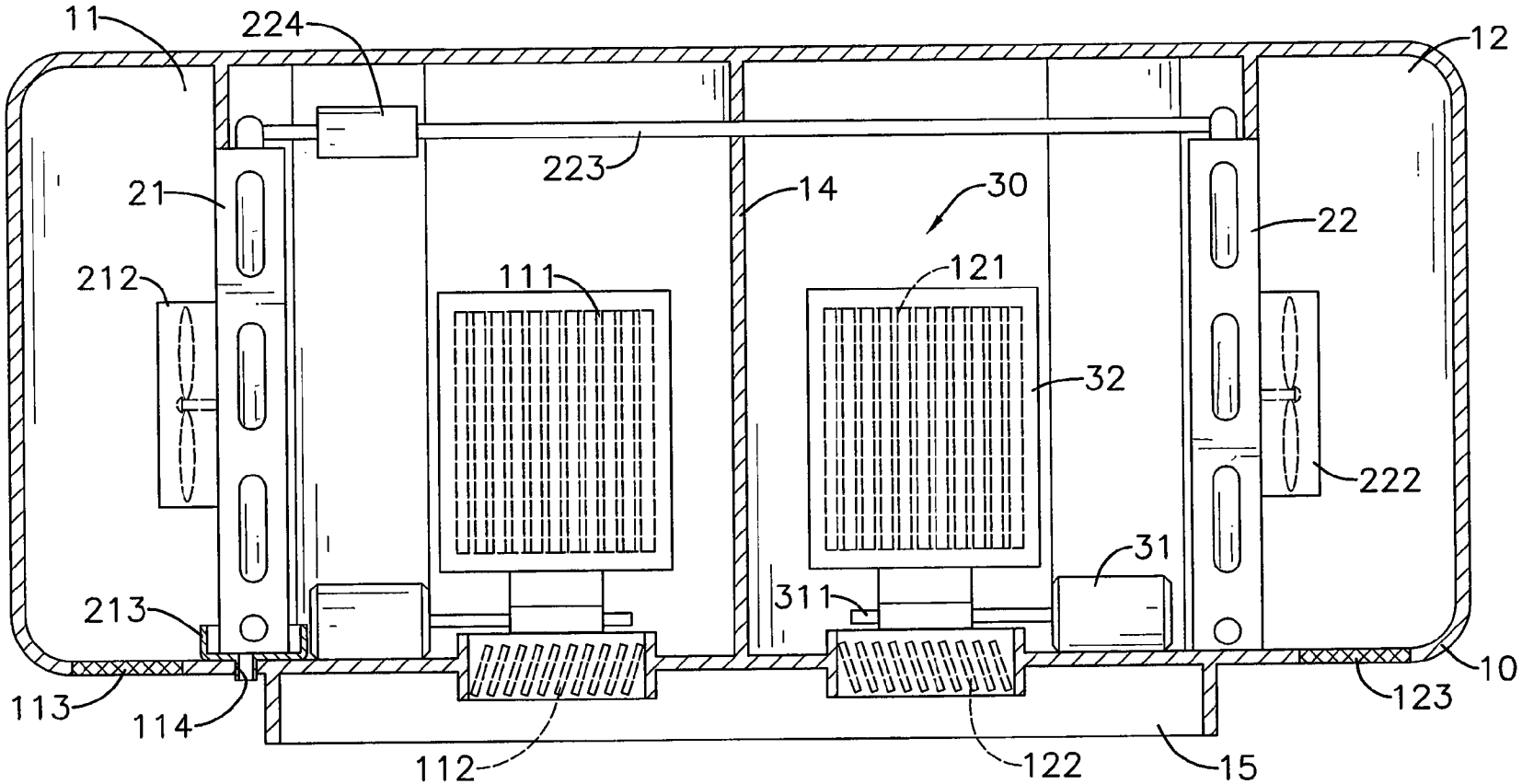
FIG. 2 is a front view in partial section of the multi-functional air conditioner in FIG. 1.

With reference to FIGS. 1 and 2, the multi-functional air conditioner comprises a casing (10), a compressor (20), an evaporator (21), a cooler (22) and two gate controllers (30).

The casing (10) has a bottom, a partition (14), an outlet (15), a compressor chamber (13), an evaporator chamber (11) and a cooler chamber (12).

The partition (14) is disposed between the evaporator chamber (11) and 14 the cooler chamber (12).

The outlet (15) is formed in the bottom of the casing (10).

The compressor chamber (13) has a side wall and a discharging hole (131) formed through the side wall.

The evaporator chamber (11) is opposite to the cooler chamber (12) and has a side wall, a first gate (111), a bottom, an inlet (113), an exhausting hole (114) and a second gate (112). The side wall is adjacent to the compressor chamber (13). The first gate (111) is mounted on the side wall of the evaporator chamber (11). The inlet (113), the exhausting hole (114) and the second gate (112) are formed in the bottom of the evaporator chamber (11), wherein the exhausting hole (114) is disposed between the inlet (113) and the second gate (112).

The cooler chamber (12) has a side wall, a third gate (121), a bottom, an inlet (123) and a fourth gate (122). The side wall is adjacent to the compressor chamber (13). The third gate (121) is mounted on the side wall of the cooler chamber (12). The inlet (123) and the fourth gate (122) are formed in the bottom of the cooler chamber (12).

The compressor (20) is mounted in the compressor chamber (13) of the casing (10).

The evaporator (21) is mounted in the evaporator chamber (11) between the inlet (113) of the evaporator chamber (11) and the second gate (112) and connects to the compressor (20) via a first pipe (211). The evaporator (21) has a bottom, a side, a fan (212) and a water collector (213). The side is adjacent to the inlet (113) of the evaporator chamber (11). The fan (212) is mounted on the side. The water collector (213) is mounted in the bottom of the evaporator (21) and connects with the exhausting hole (114) of the evaporator chamber (11).

The cooler (22) is mounted in the cooler chamber (12) between the inlet (123) of the cooler chamber (12) and the fourth gate (122), connects to the compressor (20) via a second pipe (221) and connects to the evaporator (21) via a third pipe (223) that has an expansion valve (224) mounted thereon. The cooler (22) has a side and a fan (222). The side is adjacent to the inlet (123) of the cooler chamber (12). The fan (222) is mounted on the side of the cooler (22).

The gate controllers (30) are respectively mounted in the evaporator chamber (11) and the cooler chamber (12) of the casing (10). Each gate controller (30) comprises a driver (31) and a leaf assembly (32). The driver (31) may be a motor and has a rotatable driving axle (311). One of the drivers (31) is mounted in the evaporator chamber (11) between the first gate (111) and the second gate (112), the other driver (31) is mounted in the cooler chamber (12) between the third gate (121) and the fourth gate (122). The leaf assemblies (32) are driven by the driving axles (311) of the drivers (31) to selectively close the first gate (111), the third gate (121), the second gate (112) and the fourth gate (122).

Figure 3:
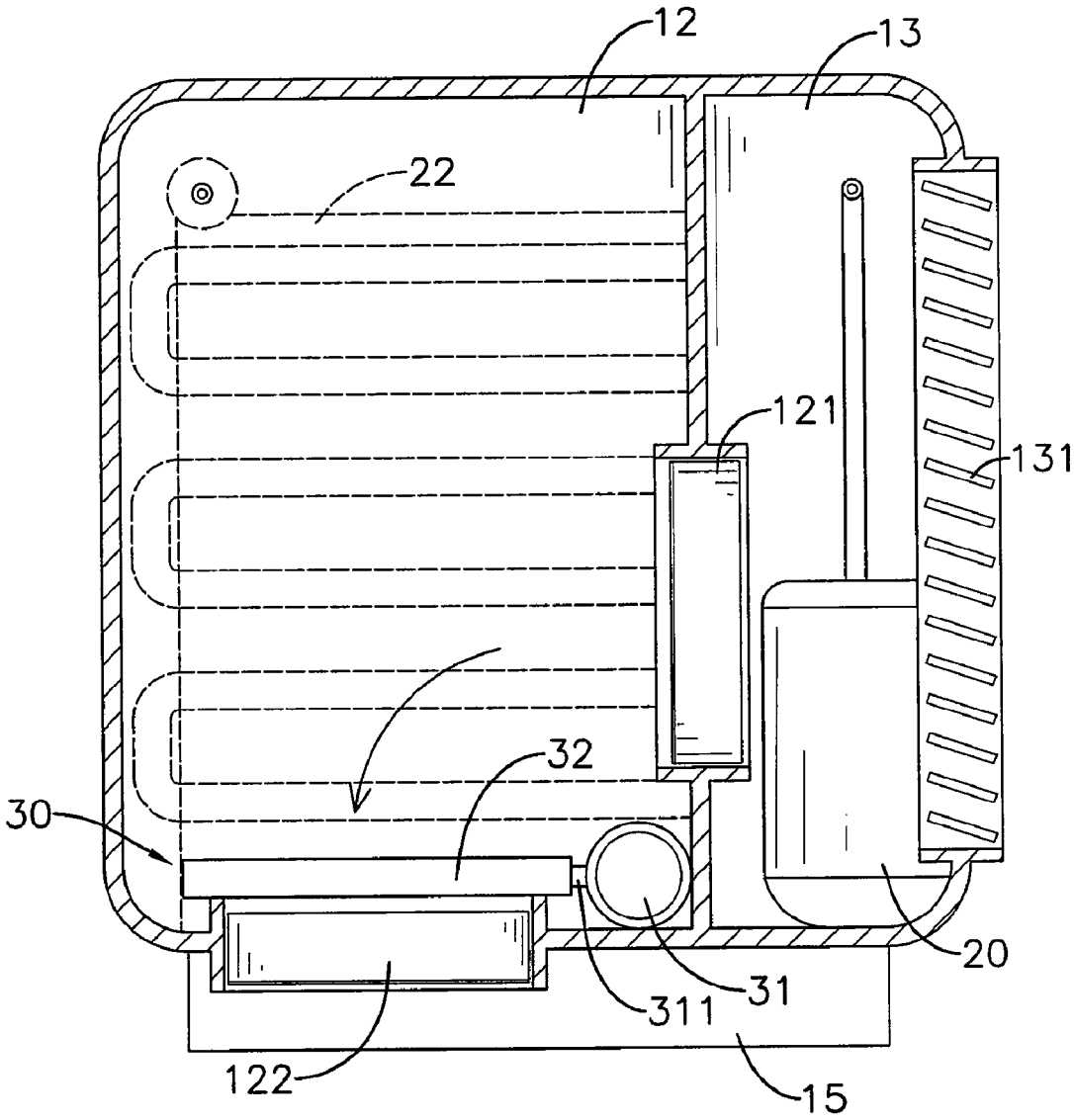
FIG. 3 is an operational side view in partial section of the multi-functional air conditioner in FIG. 1.

With reference to FIG. 3, when the multi-functional air conditioner in accordance with present invention is implemented to reduce the temperature of the outer circumstance, one of the drivers (31) drives the corresponding leaf assembly (32) to close the fourth gate (122), meanwhile, the other driver (31) drives the corresponding leaf assembly (32) to close the first gate (111). A high pressure coolant compressed by the compressor (20) may flow along the second pipe (221) and pass through the cooler (22) for heat exchanging. The heat is discharged from the third gate (121) and the discharging hole (131) to reduce temperature and provide exhausting effect as well. The cold coolant flows along the third pipe (223) to pass through the expansion valve (224) and into the evaporator (21) to cool the air flow generated by the fan (212) and entering from the inlet (113). Afterward, the cool air flow may be discharged from the second gate (112) and the outlet (15) to reduce the temperature of the outer circumstance and the coolant may keep recycling in the system. Due to the isolation of the partition (14), the heat exchanged in the cooler chamber (12) is not transmitted to the evaporator chamber (11). Furthermore, water drops formed on the evaporator (21) is gathered by the water collector (213) and discharged from the exhausting hole (114).

Figure 4:
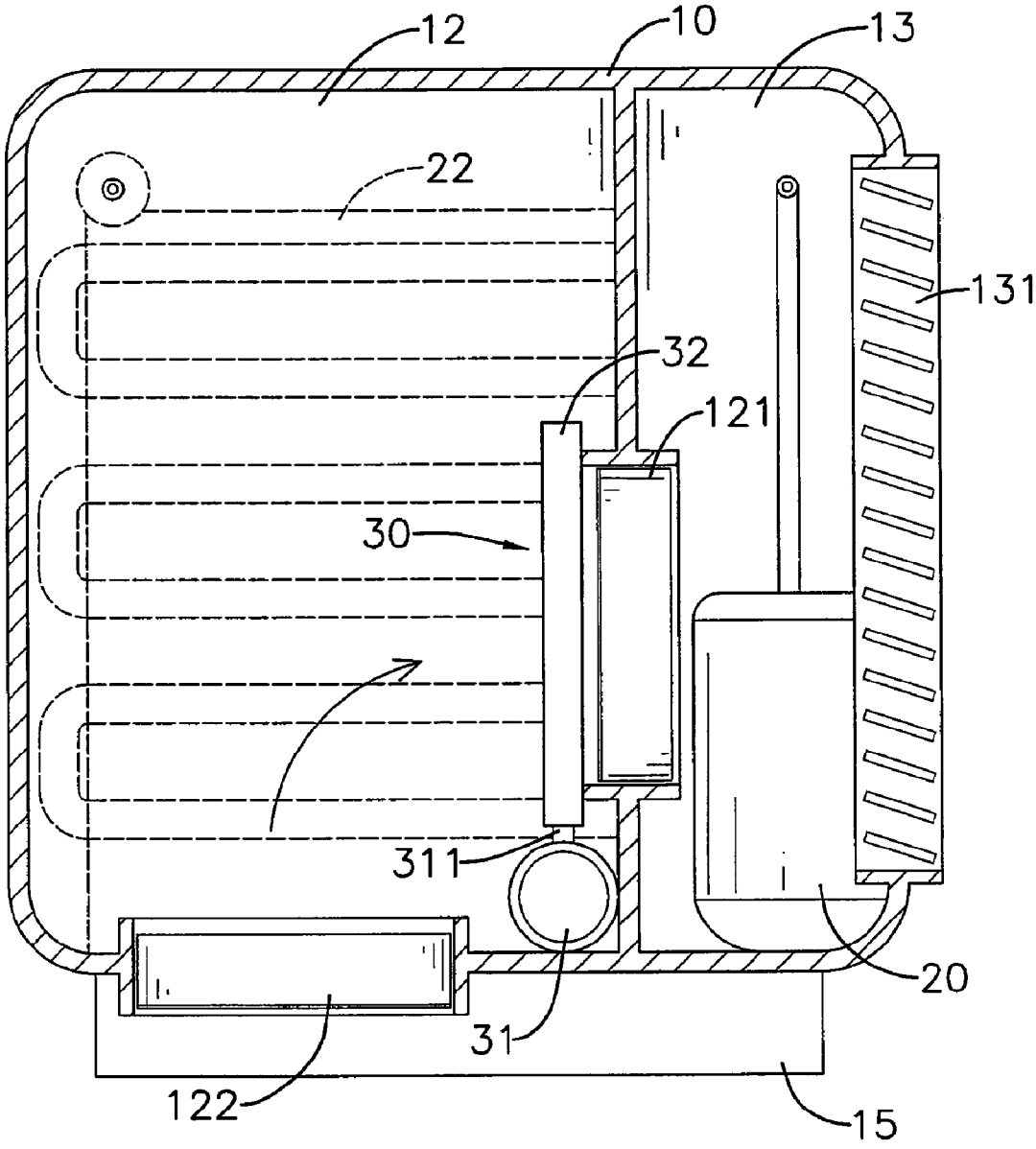
FIG. 4 is an another operational side view in partial section of the air conditioner in FIG. 1.

With reference to FIG. 4, when the multi-functional air conditioner is implemented to increase the temperature of the outer circumstance, one of the drivers (31) drives the corresponding leaf assembly (32) to close the third gate (121), meanwhile, the other driver (31) drives the corresponding leaf assembly (32) to close the second gate (112). With operation of the leaf assemblies (32) and heat exchanging via the evaporator and coolant, an air flow generated by the fan (222) may pass through the cooler (22) to absorb heat and discharged from the fourth gate (122) and the outlet (15) to increase the temperature of the outer circumstance. Meanwhile, the cool air is discharged from the first gate (111) and discharging hole (131) and providing exhausting effect.

With reference to FIG. 4, when the multi-functional air conditioner is implemented to exsiccate the air of the outer circumstance, one of the drivers (31) drives the corresponding leaf assembly (32) to close the first gate (111), meanwhile, the other driver (31) drives the corresponding leaf assembly (32) to close the third gate (121). With operation of the leaf assemblies (32) and heat exchanging via the coolant, an air flow generated by both the fans (212)(222) may pass through evaporator chamber (11) and the cooler chamber (12) via the inlets (113)(123) and become a dry and warm air flow. Such that the air flow is discharged through the outlet (15) into the outer circumstance to exsiccate the air of the outer circumstance.

When the multi-functional air conditioner is implemented to exhaust the air of the outer circumstance, the compressor (20) is inoperative and one of the drivers (31) drives the corresponding leaf assembly (32) to close the second gate (112), meanwhile, the other driver (31) drives the corresponding leaf assembly (32) to close the fourth gate (122). With operation of the leaf assemblies (32), the air of the outer circumstance may be drawn from the inlets (1 13)(123) by the fans (212)(222) and discharged into the outer circumstance from the first gate (111), the third gate (121) and the discharging hole (131) to achieve the objective of air exhausting.

Otherwise, when multi-functional air conditioner is implemented to recycle the air of the outer circumstance, the leaf assemblies (32) close the first gate (111) and the third gate (121) and the compressor (20) is inoperative. Such that the air of the outer circumstance may be drawn from the inlets (113)(123) by the fans (212)(222) and is discharged into the outer circumstance from the second gate (112), the fourth gate (122) and the outlet (15) to achieve the objective of air recycling.

Even though numerous characteristics and advantages of the present invention have been set forth in the foregoing description together with details of the structure and function of the invention, the disclosure is illustrative only. Changes may be made in detail especially in matters of shape, size and arrangement of parts within the principles of the invention to the full extent indicated by the broad general meaning of the terms in which the appended claims are expressed.

What is claimed is:

1. A multi-functional air conditioner comprising:

a casing having a bottom;

an outlet being formed in the bottom of the casing;

a compressor chamber having a side wall and a discharging hole formed through the side wall;

an evaporator chamber having a side wall being adjacent to the compressor chamber;

a first gate being mounted on the side wall of the evaporator chamber;

a bottom;

an inlet being formed in the bottom of the evaporator chamber;

a second gate being formed in the bottom of the evaporator chamber;

a cooler chamber being opposite to the evaporator chamber and having a side wall being adjacent to the compressor chamber;

a third gate being mounted on the side wall of the cooler chamber;

a bottom, an inlet being formed in the bottom of the cooler chamber; and a fourth gate being formed in the bottom of the cooler chamber; and a partition being disposed between the evaporator chamber and the cooler chamber;

a compressor being mounted in the compressor chamber of the casing;

an evaporator being mounted in the evaporator chamber between the inlet of the evaporator chamber and the second gate and connecting to the compressor via a first pipe and having a bottom;

a side being adjacent to the inlet of the evaporator chamber; and a fan being mounted on the side of the evaporator;

a cooler being mounted in the cooler chamber between the inlet of the cooler chamber and the fourth gate, connecting to the compressor via a second pipe and to the evaporator via a third pipe that having an expansion valve mounted thereon and having a side being adjacent to the inlet of the cooler chamber; and a fan being mounted on the side of the cooler; and two gate controllers being respectively mounted in the evaporator chamber and the cooler chamber of the casing to selectively close the first gate, the second gate, the third gate and the fourth gate.

2. The multi-functional air conditioner as claimed in claim 1, wherein each gate controller comprises a driver having a rotatable driving axle; and a leaf assembly being driven by the driving axle of the driver.

3. The multi-functional air conditioner as claimed in claim 2, wherein the evaporator chamber further has an exhausting hole being formed in the bottom of the evaporator chamber; and the evaporator further has a water collector being mounted in the bottom of the evaporator and connecting with the exhausting hole of the evaporator chamber.

4. The multi-functional air conditioner as claimed in claim 3, wherein the exhausting hole of the evaporator chamber is disposed between the inlet and the second gate of the evaporator chamber.

5. The multi-functional air conditioner as claimed in claim 4, wherein the driver of each gate controller is a motor.

* * * * *